United States Patent [19]

Hawkins

[11] 4,382,396

[45] May 10, 1983

[54] CAST WEB DIVERSION

[75] Inventor: William E. Hawkins, Circleville, Ohio

[73] Assignee: E. I. Du Pont de Nemours and Company, Wilmington, Del.

[21] Appl. No.: 246,013

[22] Filed: Mar. 20, 1981

[51] Int. Cl.[3] ..... B26D 1/00

[52] U.S. Cl. ..... 83/98; 83/353; 83/428; 83/433; 83/555; 83/564

[58] Field of Search ..... 83/555, 98, 99, 428, 83/353, 102, 919, 433, 564; 242/56.4, 56.5, 56.3

[56] References Cited

U.S. PATENT DOCUMENTS

| | | | |
|---|---|---|---|
| 2,665,757 | 1/1954 | Stevens et al. | 83/555 X |
| 2,837,155 | 6/1958 | Cundiff et al. | 83/919 X |
| 3,276,303 | 10/1966 | Tompos | 83/919 X |
| 3,626,798 | 12/1971 | Grierson | 83/555 X |
| 3,641,855 | 2/1972 | Balle | 83/555 X |
| 3,668,922 | 6/1972 | Fleming, Jr. et al. | 83/555 X |
| 3,732,767 | 5/1973 | Habert | 83/555 X |
| 3,756,527 | 9/1973 | Collins et al. | 242/56.6 X |
| 3,762,250 | 10/1973 | Huskey | 83/428 X |
| 3,764,085 | 10/1973 | Hawkins | 83/102 X |

*Primary Examiner*—James M. Meister

[57] ABSTRACT

An apparatus for cutting and diverting a freshly cast, polymeric web. The apparatus includes a pair of traversing knives that cut a tongue from the middle of a web and an air jet that diverts the continuously advancing tongue and web to waste.

9 Claims, 12 Drawing Figures

CAST WEB DIVERSION

BACKGROUND

This invention relates, generally, to the production of thin films and, more particularly, to a semiautomatic apparatus for cutting and diverting a continuously advancing, freshly cast web without loss of web-forwarding tension.

In existing machines, film is produced by extruding a web of molten, polymeric, film-forming materials onto a quench wheel and then advancing the web through stretching and slitting stations to one or more windups. During startup, the cast, unoriented web is led manually under the quench wheel and over rolls located adjacent the quench wheel. From those rolls, it is guided through a slot in the floor to a waste accumulator. After the desired cast profile has been achieved, a manual traversing knife is inserted through the web adjacent one of its sides to form a strip which is then cut to form a leader. When that leader has been threaded through the stretching stations to another waste collector, the traversing knife is moved across the web, thereby transferring it to the production thread-path. Next, the stretched, oriented film is routed through the slitting station to the windups. For planned stoppages at or beyond the stretching stations, the quenched web can be re-routed to the waste accumulator by first cutting a leader, guiding it to waste and then traversing the knife through the web. In the event of an unplanned stoppage, an operator uses scissors to cut a leading edge across the tough, thick, unoriented, amorphous, cast web and then must manipulate that leading edge through the slot to the waste accumulator. Forwarding tension is lost when the web is cut. The time required to accomplish this operation safely places a limit on the maximum throughput for the entire machine.

SUMMARY

The potential throughput of a machine for manufacturing film has been increased substantially by the provision of a semiautomatic apparatus for cutting and diverting a freshly cast web in its advance from a quench wheel to a stretching station. The apparatus includes a carriage mounted for movement toward and away from the path of the web and a drive for moving the carriage. A pair of knives are mounted on the carriage for pivotal movement into the web and for traversing movement in opposite directions through its width to cut a leader. There are actuators on the carriage for pivoting and traversing the knives and an air jet for diverting the leader to a waste collector.

DRAWINGS

DESCRIPTION

Figure 1:
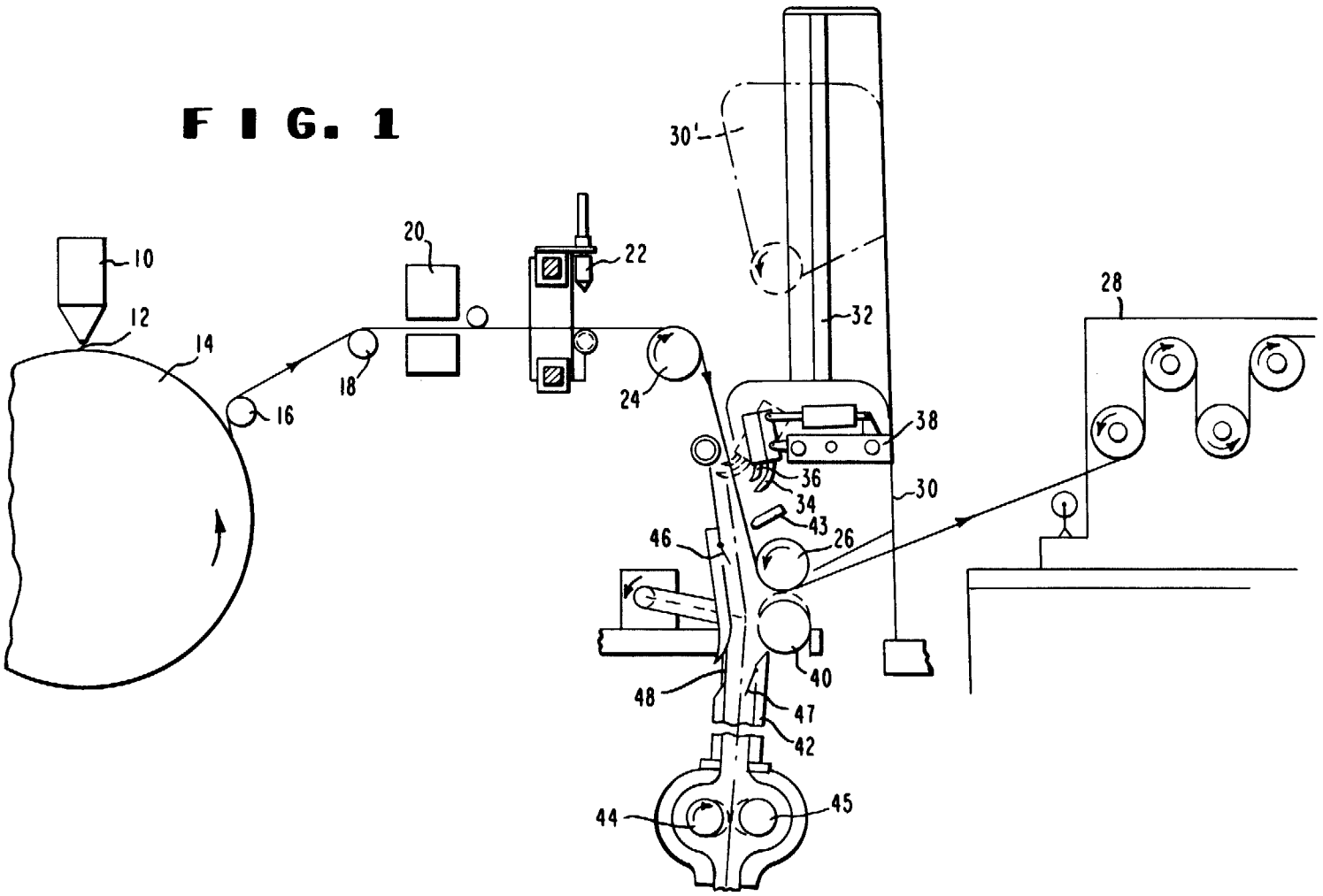
FIG. 1 is a schematic illustration of the apparatus of the present invention and its association with adjacent stations in a machine for manufacturing film.

Referring to FIG. 1, the machine into which the apparatus of this invention has been incorporated includes a die 10 from which a web 12 of molten polymer is extruded and cast onto a quench wheel 14. Web 12 is stripped from wheel 14 and guided over support rolls 16, 18, through a gauge 20 for measuring web thickness and past a manually operated, traversing knife 22 to a roll 24. The web then advances over a roll 26 to a stretching station 28 where it is orientation drawn in the machine direction (MD). At a subsequent stretching station, the web is drawn in the transverse direction (TD). Then, in normal production, the resulting thin film is advanced through a slitting station to multiple windups.

Figure 4:
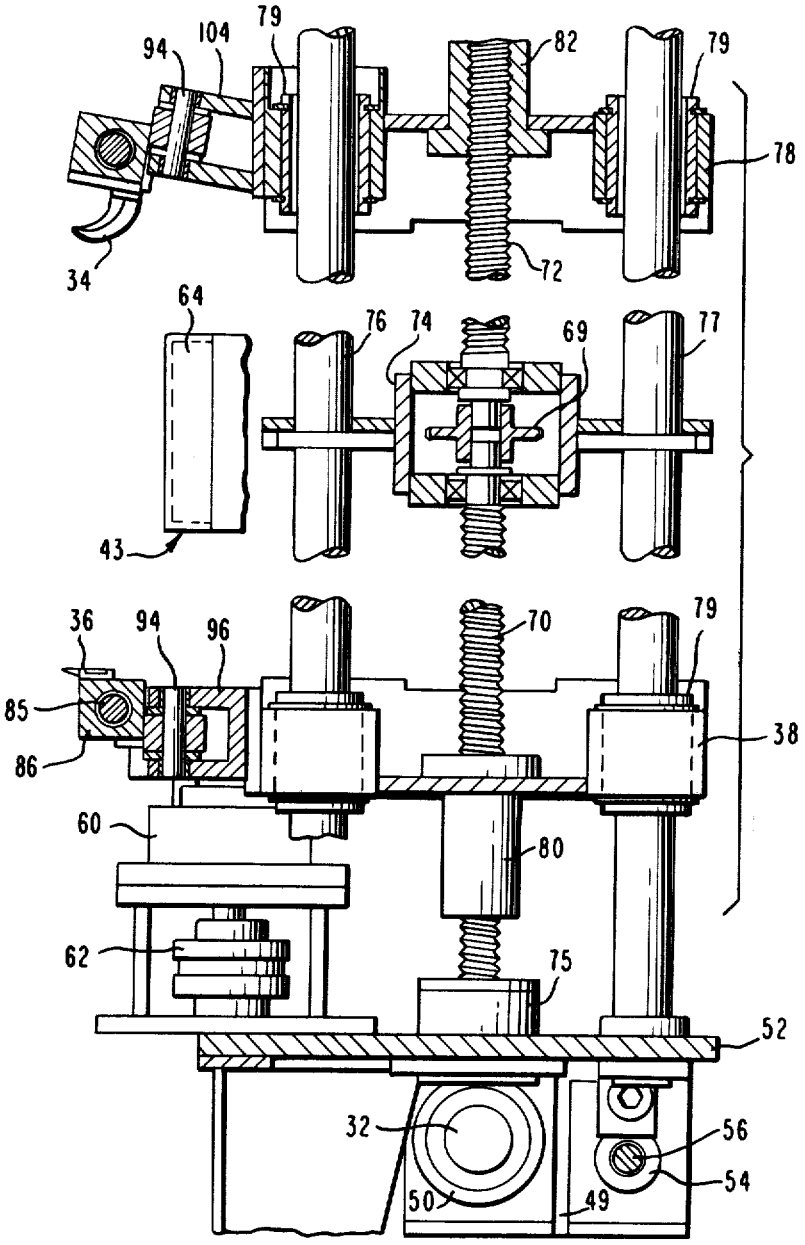
FIG. 4 is a fragmentary, sectional view taken on irregular line IV—IV in FIG. 3 except for a few parts shown in full lines to reveal details of construction and arrangement.
Figure 7:
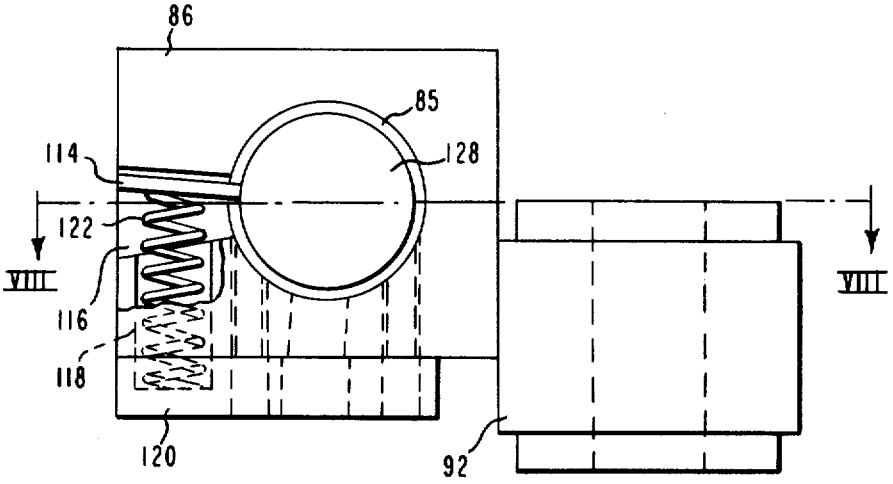
FIGS. 7-10 are detailed illustrations of parts and elements involved in rotational movements of the knives, FIG. 8 having been taken on line VIII—VIII in FIG. 7.
Figure 8:
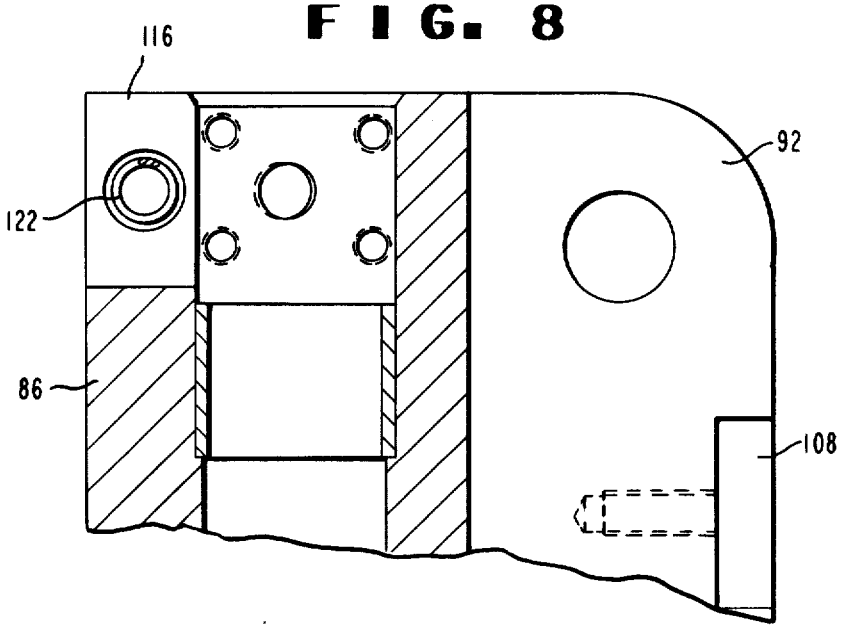
Figure 9:
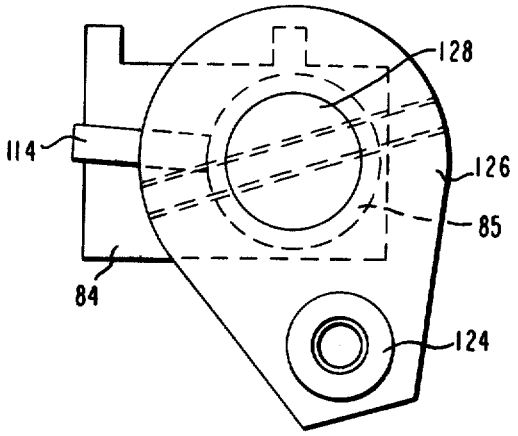
Figure 10:
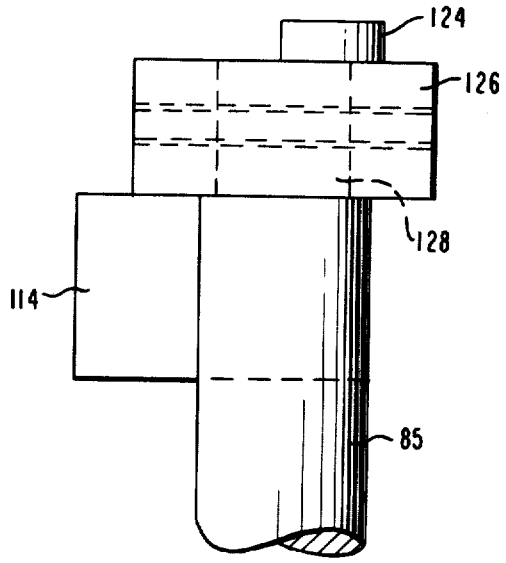

The apparatus of the invention includes a carriage 30 slidably mounted on guides 32 located on opposite sides of the path of advance for web 12; the guide on the right hand (RH) side of the machine appears in FIG. 1. Roll 26 is rotatably mounted on carriage 30. A pair of knives 34, 36 are mounted for pivotal movement into the path of web 12 and for rotation about their axes. Each knife is carried by a traversing block; the block for left hand (LH) knife 36 appears at 38 in FIG. 1. The manner in which the knives 34, 36 are traversed in opposite directions from a home position adjacent the center of the web 12 is shown in FIGS. 2 and 4.

In the event of a stoppage, whether planned or unplanned, actuators for knives 34, 36 and a roll 40 are energized by signals from the logic unit in a programmed controller. Typically, an unplanned stoppage is initiated automatically by the detection of a break in the web at MD stretching station 28. Roll 40 is swung into a nipping engagement with roll 26 and knives 34, 36 cut a tongue from web 12. That tongue is diverted to a chute 42 by a jet device 43 and guided between a pair of rolls 44, 45 by air streams in the chute. The air streams are introduced through slot jets 46, 47. Excess air is exhausted through a vaned opening 48 and a Coanda surface is provided between slot jet 46 and opening 48. After the tongue reaches rolls 44, 45, actuators move the rolls 44, 45 into nipping engagement and the tongue is delivered to a waste shredder. By this time, knives 34, 36 have travelled through the edges of the web and are returned to their home positions. The full width of web 12 is advanced to waste by nip rolls 44, 45; the trailing end of the cut length is exhausted into the aisle between carriage 30 and MD stretching station 28. Web-forwarding tension is retained on both lengths, throughout the cut-and-divert cycle, by rolls 26, 40, 44, 45.

Figure 2:
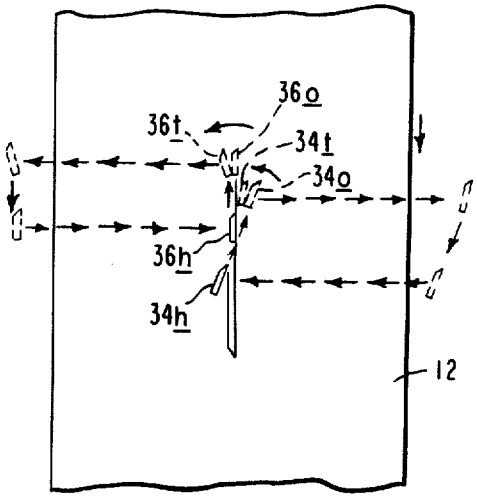
FIG. 2 is a schematic illustration of motions imparted to the knives shown in FIG. 1.
Figure 6A:
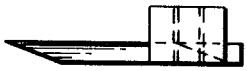

Home positions for the RH and LH knives are shown at 34*h*, 36*h* in FIG. 2. When first inserted through web 12, the leading LH knife has its cutting edge disposed in parallelism with the machine direction. Before its insertion, the cutting edge of the trailing RH knife is located slightly to the left of the LH cutting edge and is disposed at an intersecting angle with respect to the MD slit to be cut by the LH knife. During a cutting cycle, the knives are sequenced, as follows:

the knives are pivoted into operative positions 36*o*, 34*o*, both knives are rotated to traversing positions 34*t*, 36*t*, and the knives are traversed in opposite directions through the edges of web 12, withdrawn and traversed back to their home positions.

Figure 3:
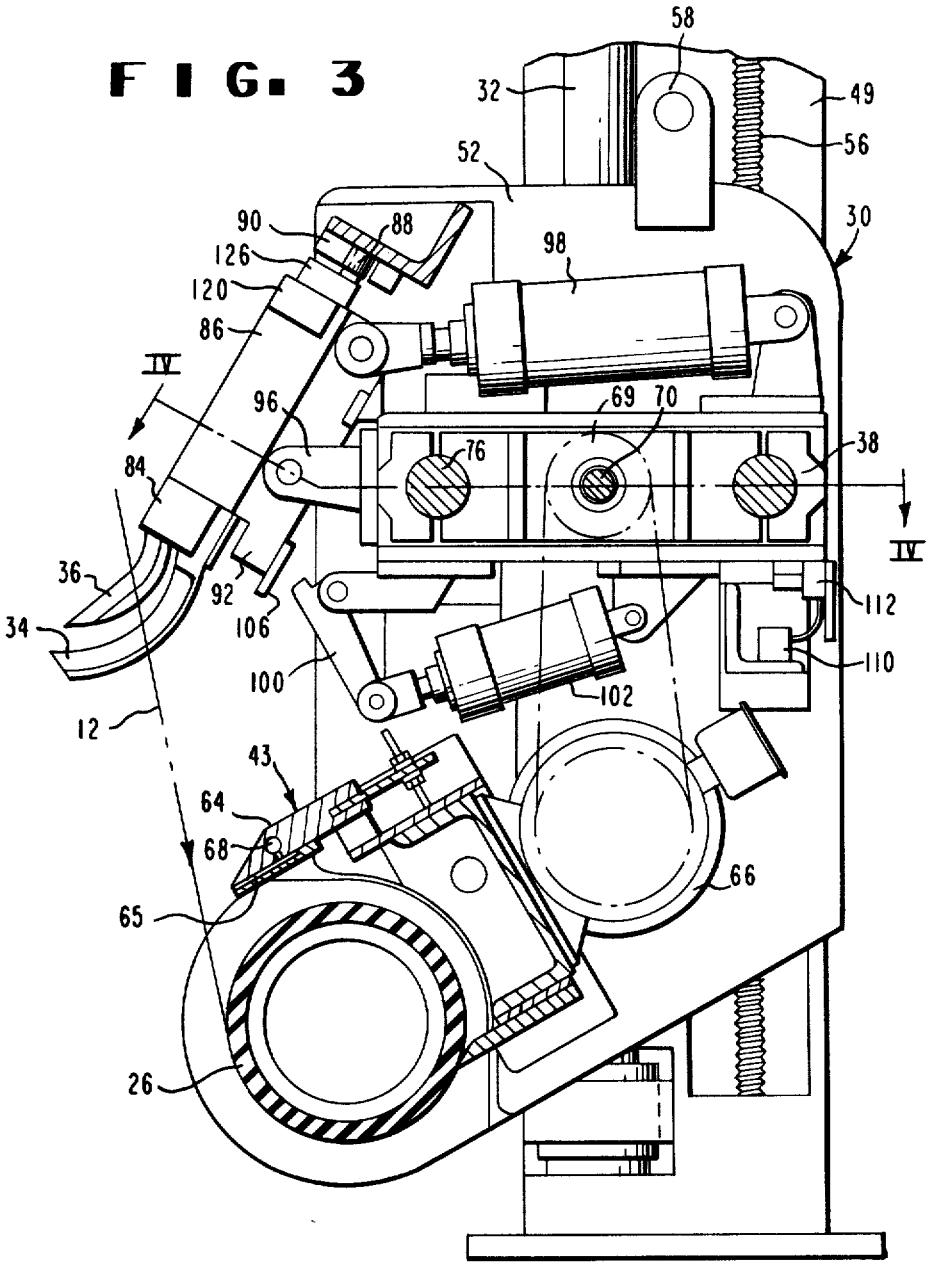
FIG. 3 is a sectional elevation of the apparatus.

Structural arrangements and relationships in a useful embodiment of the apparatus are shown in FIGS. 3 and 4. Guides 32 are attached to upright frame members 49 located at the sides of the machine and receive bushings 50 that are carried by side plates 52 of carriage 30. Each side plate 52 also carries an internally threaded follower 54 that receives an upright drive screw 56. Screws 56 are driven through a gear box on a horizontal frame member atop frame members 49 and operate to raise and lower the carriage between the positions shown in FIG. 1. The carriage can be locked in the raised position, during startup, by pinning an ear 58 to a similar ear on the horizontal frame member.

Roll 26 is supported by bearings in a flange block 60 and is driven through a coupling 62 by a speed reducer and motor mounted on the LH side plate 52.

Air jet assembly 43 includes a pair of plates 64, 65 that are bracketed to the mount for a motor 66. Plate 64 has an elongated plenum 68 that is connected to a valved source of air under pressure and discharges to a slot jet defined by a groove milled into the adjacent face of plate 65. The jet is directed at the path of advance of web 12. Motor 66 is coupled to a sprocket wheel 69 through a chain. Wheel 69 is coupled to a LH screw 70 and a RH screw 72. The inner ends of screws 70, 72 are supported by bearings located in a box 74 and the outer ends by bearings 75 mounted on side plates 52 of carriage 30. Box 74 is bracketed at the mid-points of guide shafts 76, 77 for LH and RH traversing blocks 38, 78. Blocks 38, 78 carry bushings 79 that receive shafts 76, 77 and, between the bushings, internally threaded sleeves 80, 82 that receive the screws 70, 72. In this manner, blocks 38, 78 are traversed to-and-fro the home positions of knives 36, 34.

LH knife 36 is fastened to the bottom end of a holder 84 that is round in a mid-length 85 (FIG. 4). Length 85 is rotatable in a bore that extends through a bar 86. At the upper end of holder 84, there is a follower 88 that travels in an elongated cam 90 as block 38 is traversed. Cam 90 is attached to a part on the frame. Along its side, bar 86 is attached rigidly to another bar 92 which is pivoted at 94 between the spaced ears of a mounting bracket 96 carried by block 38. At its upper end, bar 92 is pivotally attached to the rod of an actuator 98. The other end of actuator 98 is pivoted to a bracket attached to the top of block 38. When actuator 98 is extended to move knife 36 out of the path of advance for web 12, a catch at the inner edge of bar 92 is latched by a detent 100 that is pivoted to the rod of an actuator 102.

Figure 5A:
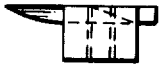
FIGS. 5A, 6A are top views
Figure 5B:
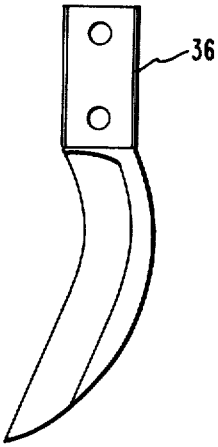
FIGS. 5B, 6B are elevations of the knives shown in FIGS. 1-4.
Figure 6B:
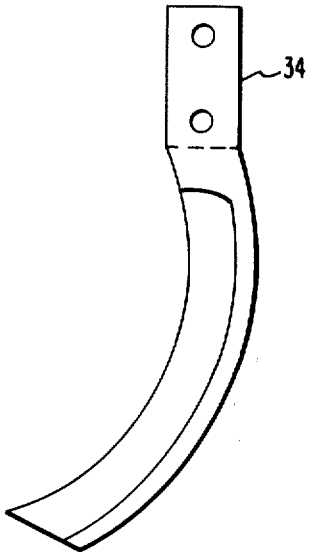

RH knife 34 is mounted and actuated in the same manner as knife 36 except that its mounting bracket 104 is disposed at angles slightly divergent from parallelism with planes in and perpendicular to the normal path of travel for web 12, i.e., the mount for knife 34 is tilted about two axes. As a consequence, the cutting edge of knife 34 is slightly to the left of knife 36 when both are in the home positions **34*h*, 36*h* (FIG. 2). Another factor bearing on the position of the cutting edge of knife 34 when in the home position is its relative length (FIGS. 5B and 6B**).

During startup, the carriage is raised to the elevated position shown at 30' in FIG. 1. When a full web has been established to and through the stretching stations, the carriage is lowered to its operating position. Then, the molecularly oriented, thin film is routed through the slitting station to the windups. In the event of a stoppage, whether planned or unplanned, web 12 is automatically cut and diverted to waste in a set sequence of activities, as follows:

nip roll 40 engages transfer roll 26,

LH knife 36 is inserted through web 12 in a snap action,

RH knife 34 is pivoted through the mitered edge cut by lead knife 36, the knives are rotated to their traversing positions **36*t*, 34*t*, the knives traverse toward the edges of web 12, air jet 43 diverts the tongue cut by knives 34, 36 to chute 42, rolls 44, 45 close on the tongue, the knives traverse through the web, retract and return to their home positions, carriage 30 is raised and locked manually in its elevated position, and nip roll 40** retracts.

As indicated above, knife 36 is inserted into the taut, tensioned web 12 in a snap action. That action is initiated by pressurizing actuator 98 in advance of actuator 102. When the latter is pressurized, detent 100 releases bar 92 and the sharp point of knife 36 is pivoted through the web. Only one side of the sickle blade on knife 36 is bevelled. The other side is flat. Thus, with knife 36 mounted as shown in FIGS. 2–4, it cuts a slit with a mitered or square right edge. That mitered edge presents an ideal target for the tilted, sickle blade on knife 34 as it is inserted into the web. Like knife 36, the sickle blade of knife 34 is also flat on its right side and bevelled on its left side (FIGS. 2, 5B, 6B)

Controls for initiating the motions and sequences outlined above are in the form of limit switches, break detectors and similar devices already known to those skilled in the art. Two examples of plates adapted to engage limit switches are shown at 106, 108 on bar 92 (FIG. 3). Another limit switch and its actuator are shown at 110, 112 in FIG. 3; it is the signal from switch 110 that stops the drive for screws 70, 72 when traversing knives 34, 36 reach their home positions. Similar devices located throughout the machine are connected to the programmed controller which, in turn, provides control signals for such elements as actuators 98, 102.

Parts, elements and relationships for imparting rotational motions to LH knife 36 are shown in FIGS. 7–10. Length 85 of holder 84 has a blade 114 press-fitted in a slot therethrough and extending therefrom into a wedge shaped opening 116 in the upper end of bar 86. A passage 118 extends from opening 116 through bar 86 and into a retainer plate 120 for a spring 122 that engages blade 114 and biases the LH knife toward its position **36*h* (FIG. 2). At the outset of traversing motion, the cam follower 88 engages cam 90 (FIG. 3) and, against the bias of spring 122, rotates the LH knife to its position 36*t*. Follower 88 is carried by an internally threaded boss 124 on a lever 126 that is pinned to an upper, reduced end 128 of knife holder 84. When the LH knife has moved through the edge of web 12, follower 88 leaves cam 90 and spring 122 returns it to its position 36*h*. Functionally similar parts and elements impart rotational motions to RH knife 34**.

In a usage of a machine equipped with the apparatus disclosed herein, divert efficiency over an extended period was 100% and this permitted an increase of about 6.5% in its throughput.

What is claimed as new and desired to be secured by Letters Patent is:

1. In a machine including a quench wheel over which a freshly cast web is advanced to a stretching station, an apparatus for cutting and diverting the web, said apparatus comprising: a carriage mounted for movement toward and away from a normal position adjacent the path of the web; drive means connected to the carriage for moving it; a pair of sickle blades mounted on the carriage for pivotal movement into said path and for traversing movement in opposite directions through the edges of said path whereby to cut a leader; actuators on the carriage for pivoting and traversing the blades; and a waste collector positioned to receive the leader and advancing web.

2. The machine of claim 1 further comprising a driven roll on said carriage adapted to engage the web and a cooperating nip roll.

3. The machine of claim 2 further comprising an air jet on the carriage for diverting the leader to said collector.

4. In a machine including a quench wheel over which a freshly cast web is advanced to a stretching station, a cut-and-divert apparatus comprising: a carriage carrying a roll and a pair of knives; means mounting the carriage for movement to and from a position in which the roll engages the film between the quench wheel and the stretching station; means mounting each knife on the carriage for pivotal movement into and out of the path over which the web advances to said roll and for rotation with respect to that path; actuators for pivoting the knives and rotating them into divergent positions adjacent the center of said path; and drive means for traversing the knives in opposite directions and through the edges of said path whereby to start a tongue; an air jet for diverting the tongue away from said path; and a waste collector positioned to receive the diverted tongue and web.

5. The machine of claim 4 further comprising a pair of normally spaced rolls in said collector and means for moving these rolls into nipping engagement with the tongue, said carriage then being adapted for movement away from said path.

6. The machine of claim 5 wherein said collector includes a chute equipped with opposed air jets for directing the leader between said spaced rolls.

7. The machine of claim 5 wherein is provided an opening in said chute for the escape of excess air.

8. The machine of claim 4 further comprising elongated guide means extending across said carriage and a pair of blocks slidable on the guide means, each block carrying a knife.

9. The machine of claim 8 wherein is provided a stop means on the carriage between said blocks for limiting their traversing movement and defining home positions for the knives.

* * * * *